US008298355B2

(12) United States Patent
Yoshizawa et al.

(10) Patent No.: US 8,298,355 B2
(45) Date of Patent: Oct. 30, 2012

(54) MAGNETIC ALLOY, AMORPHOUS ALLOY RIBBON, AND MAGNETIC PART

(75) Inventors: Yoshihito Yoshizawa, Kumagaya (JP); Motoki Ohta, Kumagaya (JP)

(73) Assignee: Hitachi Metals, Ltd., Tokyo (JP)

( * ) Notice: Subject to any disclaimer, the term of this patent is extended or adjusted under 35 U.S.C. 154(b) by 195 days.

(21) Appl. No.: 12/529,148

(22) PCT Filed: Mar. 5, 2008

(86) PCT No.: PCT/JP2008/053935

§ 371 (c)(1),
(2), (4) Date: Aug. 28, 2009

(87) PCT Pub. No.: WO2008/114611

PCT Pub. Date: Sep. 25, 2008

(65) Prior Publication Data

US 2010/0040503 A1 Feb. 18, 2010

(30) Foreign Application Priority Data

Mar. 16, 2007 (JP) ..... 2007-068868

(51) Int. Cl.

| | |
|---|---|
| ***C22C 45/00*** | (2006.01) |
| *C22C 38/00* | (2006.01) |
| *C22C 38/60* | (2006.01) |
| *C22C 38/16* | (2006.01) |

(52) U.S. Cl. ..... 148/403; 148/320; 420/82; 420/84; 420/89

(58) Field of Classification Search ..... 148/403; 420/82, 83, 87, 89, 92

See application file for complete search history.

(56) References Cited

U.S. PATENT DOCUMENTS

| | | | |
|---|---|---|---|
| 5,815,060 | A | 9/1998 | Matsumoto et al. |
| 6,425,960 | B1 | 7/2002 | Yoshizawa et al. |
| 7,442,263 | B2 | 10/2008 | Gunther et al. |

FOREIGN PATENT DOCUMENTS

| | | | |
|---|---|---|---|
| CN | 1475018 | A | 2/2004 |
| JP | 1-156451 | A | 6/1989 |
| JP | 1-290746 | | 11/1989 |
| JP | 5-140703 | A | 6/1993 |
| JP | 6-220592 | | 8/1994 |
| JP | 7-201610 | A | 8/1995 |
| JP | 2004-353090 | A | 12/2004 |
| JP | 2005-68451 | A | 3/2005 |
| JP | 2006-040906 | A | 2/2006 |
| JP | 2006-241569 | A | 9/2006 |
| WO | 2007/032531 | A1 | 3/2007 |

OTHER PUBLICATIONS

Chinese Office Action Dated Jul. 27, 2010.
European Search Report dated Aug. 10, 2010.

*Primary Examiner* — Jessica L Ward
*Assistant Examiner* — Alexander Polyansky
(74) *Attorney, Agent, or Firm* — Sughrue Mion, PLLC

(57) ABSTRACT

A soft magnetic alloy that in an FeCo nanocrystal soft magnetic material, exhibits a high saturation magnetic flux density of 1.85 T or more, and that ensures prolonged nozzle life and easy ribbon production; an amorphous alloy ribbon for use in production thereof; and magnetic parts utilizing the soft magnetic alloy. The soft magnetic alloy has the composition of the formula $Fe_{100-x-y-a}Co_aCu_xB_y$ (in the formula, x, y and a each represent atomic % and satisfy the relationships $1<x\leqq3$, $10\leqq y\leqq20$ and $10<a<25$). At least part of the structure thereof consists of a crystal phase of 60 nm or less (not including 0) crystal grain diameter. The soft magnetic alloy has a saturation magnetic flux density of 1.85 T or more and a coercive force of 200 A/m or less.

7 Claims, 1 Drawing Sheet

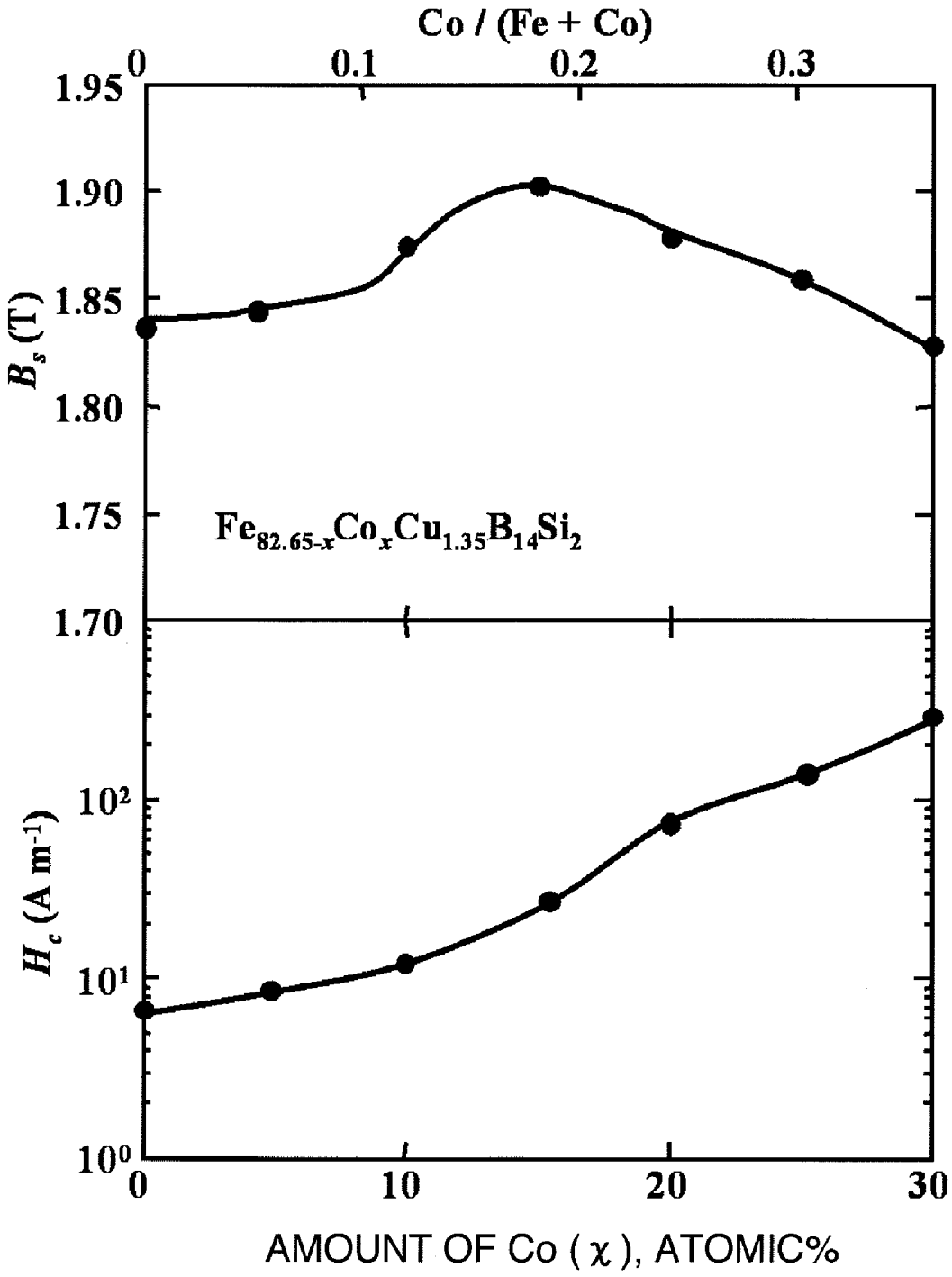
Co / (Fe + Co)
0
0.1
0.2
0.3
1.95
1.90
1.85
1.80
1.75
1.70
$B_s$ (T)
$Fe_{82.65-x}Co_xCu_{1.35}B_{14}Si_2$
$10^2$
$10^1$
$10^0$
$H_c$ (A m$^{-1}$)
0
10
20
30
AMOUNT OF Co ( χ ), ATOMIC%

MAGNETIC ALLOY, AMORPHOUS ALLOY RIBBON, AND MAGNETIC PART

CROSS REFERENCE TO RELATED APPLICATIONS

This application is a National Stage of International Application No. PCT/JP2008/053935 filed Mar. 5, 2008, claiming priority based on Japanese Patent Application No. 2007-068868, filed Mar. 16, 2007, the contents of all of which are incorporated herein by reference in their entirety.

TECHNICAL FIELD

The present invention relates to a soft magnetic alloy that has high saturation magnetic flux density and is used for magnetic alloys, in particular, various transformers, various reactors, noise-suppression measures, laser power supplies, pulsed-power magnetic parts for accelerators, various motors, various generators and so on, a thin ribbon of an amorphous alloy for producing the magnetic alloy, and a magnetic part that uses the magnetic alloy.

BACKGROUND ART

Examples of a magnetic material that has high saturation magnetic flux density and a low coercive force and is used for various transformers, various reactors, noise-suppression measures, laser power supplies, pulsed-power magnetic parts for accelerators, various motors, various generators and so on include a silicon steel, ferrite, an amorphous alloy, and an Fe-based nanocrystalline alloy material.

A silicon steel sheet is a cheap material with a high magnetic flux density, but it has a problem in that the magnetic core loss is large for the use in high frequency. From the viewpoint of a producing method, it is very difficult to produce a thin silicon steel sheet equivalent to amorphous ribbons, and, since an eddy current loss is large, a core loss is disadvantageously large. Furthermore, a problem of a ferrite material is that the saturation magnetic flux density is low and temperature characteristics are poor; accordingly, ferrite that readily magnetically saturates is disadvantageous for a high power application where an operating magnetic flux density is large.

A Co-based amorphous alloy has a problem that a low saturation magnetic flux density is 1 T or less for a practical material and thermal stability is poor. Accordingly, when the Co-based amorphous alloy is used in high power use, there is a problem that a part becomes larger and a magnetic core loss increases with time.

Still furthermore, an Fe-based amorphous soft magnetic alloy such as disclosed in PATENT DOCUMENT 1 has excellent squareness characteristics and a low coercive force and exhibits excellent soft magnetic characteristics. However, an Fe-based amorphous alloy system has a physical upper limit value of saturation magnetic flux density at substantially 1.7 T. Furthermore, a problem of an Fe-based amorphous alloy is that magnetostriction is large and the characteristics deteriorate by stress, and another problem thereof is that in an application where currents in the audible frequency range are superposed, sound noise is large. In this connection, a nanocrystalline soft magnetic material such as described in PATENT DOCUMENT 2 has been developed and used in various applications. As an amorphous alloy having higher saturation magnetic flux density, an FeCo amorphous alloy is known. However, a problem of such an amorphous alloy is that the limit value of saturation magnetic flux density is substantially 1.8 T and magnetostriction is very large. As a soft magnetic formed body having high magnetic permeability and high saturation magnetic flux density, a technology such as described in PATENT DOCUMENT 3 is disclosed. Furthermore, in a nanocrystalline soft magnetic material, an attempt has been made to add Co to further improve the saturation magnetic flux density. In PATENT DOCUMENT 4, it is reported that in an FeCoCuNbSiB alloy high saturation magnetic flux density exceeding 1.8 T is obtained.

PATENT DOCUMENT 1: JP-A-05-140703 (paragraph Nos. 0006 to 0010)

PATENT DOCUMENT 2: JP-A-01-156451 (from line 19 in the upper right column to line 6 in the lower right column on page 2)

PATENT DOCUMENT 3: JP-A-2006-40906 (paragraph Nos. 0040 to 0041)

PATENT DOCUMENT 4: JP-A-2006-241569 (paragraph Nos. 0016 to 0017)

DISCLOSURE OF THE INVENTION

Problems to be Solved by the Invention

Among the nanocrystalline soft magnetic materials containing Co, a nanocrystalline soft magnetic material that has a saturation magnetic flux density exceeding 1.8 T has been reported. However, in particular problems of a material exceeding 1.85 T are that the life of a nozzle for preparing a thin ribbon is short and that the raw material cost becomes higher because the amount of Co is as high as 25 atomic % or more.

An object of the present invention is to provide, in an FeCo nanocrystalline soft magnetic material, a soft magnetic alloy that has a high saturation magnetic flux density of 1.85 T or more and an a prolonged nozzle life and makes it easy to produce a thin ribbon, a thin ribbon of an amorphous alloy for producing the same, and a magnetic part that uses the soft magnetic alloy.

Means for Solving the Problems

In the present invention, with the object of realizing, in an FeCo alloy, a soft magnetic alloy that has a high saturation magnetic flux density B, of 1.85 T or more, is capable of obtaining excellent soft magnetic properties, has a longer nozzle life and is excellent in mass-productivity, the present inventors have studied hard. As a result, the inventors have found that a magnetic alloy that is represented by the compositional formula: $Fe_{100-x-y-a}Co_aCu_xB_y$ (wherein, in terms of atomic percent, $1<x\leqq 3$, $10\leqq y\leqq 20$, and $10<a<25$) wherein at least a part of the structure thereof is a crystalline phase having a crystal grain diameter of 60 nm or less (not including 0) exhibits excellent characteristics, namely the saturation magnetic flux density is 1.85 T or more and the coercive force is 200 A/m or less, is wide in annealing conditions for obtaining soft magnetic properties, is less in variation and is excellent in mass-productivity, and have conceived the present invention.

In the present invention, a magnetic alloy that is represented by the compositional formula: $Fe_{100-x-y-z-a}Co_aCu_xB_yX_z$ (wherein, X is one or more elements selected from the group consisting of Si, S, C, P, Al, Ge, Ga and Be, and, in terms of atomic percent, $1<x\leqq 3$, $10\leqq y\leqq 20$, $0<z\leqq 10$, $10<a<25$, and $10<y+z\leqq 24$) wherein at least a part of the structure thereof is a crystalline phase having a crystal grain diameter of 60 nm or less (not including 0) is preferably wider in the range of annealing conditions for obtaining soft magnetic properties. In particular, when the X is one or more elements selected from the group consisting of Si and P, in particular, the annealing temperature range is wide and variation can preferably be made smaller.

When Si is added, a temperature where a ferromagnetic compound phase large in a crystalline magnetic anisotropy starts precipitating becomes higher; accordingly, an annealing temperature is allowed to set higher. When an annealing is applied at a high temperature, the ratio of a nanocrystalline phase increases to result in preferably increasing $B_s$. Furthermore, an addition of Si is effective in inhibiting a sample surface from being modified and discolored.

In order to obtain a homogeneous microstructure in the soft magnetic nanocrystalline alloy of the present invention, it is important to be able to obtain a structure having an amorphous phase as a main phase at the time point when a thin ribbon of an alloy is prepared by melt quenching after a raw material is melted. In the present invention, when nanoscale fine crystal grains are present dispersed in thin amorphous alloy ribbon prepared by a melt quenching method, crystal grains are made finer and thereby a preferable result is obtained. Thereafter, an annealing is applied in a temperature range equal to or more than a crystallization temperature to form a structure where crystal grains of a body-centered cubic structure having a crystal grain diameter of 60 nm or less are dispersed at a volume fraction of 30% or more in an amorphous matrix phase. When a nanocrystalline grain phase is present at a volume fraction of 30% or more, the saturation magnetic flux density Bs can be increased more than a state of an amorphous single phase. Furthermore, when the nanocrystalline grain phase is contained 50% or more by volume fraction, Bs is further increased.

The volume fraction of crystal grains is obtained by a linear analysis method, that is, an arbitrary straight line is assumed in a microscope structure, the length of a test line is represented by Lt and the length Lc of a line occupied by a crystal phase is measured, and the ratio $L_L=L_C/L_t$ of the length of the line occupied by crystal grains is obtained. Here, the volume fraction of crystal grains is $V_v=L_L$.

The amount of Cu (x) is set at $1 \leqq x \leqq 3$. When the amount of Cu (x) exceeds 3.0%, it is very difficult to obtain a thin ribbon with an amorphous phase as a main phase during a melt quenching, and the soft magnetic properties as well rapidly deteriorate. On the other hand, when the amount of Cu (x) is 1% or less, the range of the appropriate annealing conditions becomes narrower and the coercive force increases to unfavorably reduce the soft magnetic properties. The amount of Cu is preferably $1<x \leqq 2$. The amount of B (y) is set at $10 \leqq y \leqq 20$. When the amount of B is less than 10%, it becomes very difficult to obtain a thin ribbon with an amorphous phase as a main phase. On the other hand, when the amount of B (y) exceeds 20%, the saturation magnetic flux density unfavorably deteriorates. The amounts of Cu (x) and B (y) are preferably $1.2<x \leqq 1.8$ and $12 \leqq y \leqq 17$, respectively and more preferably $1.2 \leqq x \leqq 1.6$ and $14 \leqq y \leqq 17$, respectively. When the amount of Cu and the amount of B are set in the ranges, in particular, the soft magnetic properties can be rendered excellent, the production can be made easier, and variation in characteristics caused by an annealing can be reduced.

In the present invention, in the case where, before an annealing, an alloy does not include an amorphous phase and is made of only crystal, a low coercive force is not obtained. However, in the case of a structure where nanoscale crystal grains are dispersed less than 30% in an amorphous phase, a low coercive force is obtained even after an annealing. B is an indispensable element for promoting formation of an amorphous phase, and Si, S, C, P, Al, Ge, and Ga contribute to improving the forming ability of an amorphous phase. The concentration of B (y) is $10 \leqq y \leqq 20$, and this is a composition range that allows stably obtaining an amorphous phase with a restriction on the amount of Fe satisfied.

The magnetic alloy can contain Ni less than 2 atomic % relative to the amount of Fe. Addition of Ni is effective in controlling induced magnetic anisotropy and in improving corrosion resistance.

Furthermore, the magnetic alloy can contain at least one element selected from Ti, Zr, Hf, V, Nb, Ta, Cr, Mo, W, Mn, Re, platinum group elements, Au, Ag, Zn, In, Sn, As, Sb, Bi, Y, N, O and rare earth elements by less than 1 atomic % with respect to the amount of Fe. Addition of the elements helps fine crystal grains grow and contributes to improvement in soft magnetic properties.

A specific producing method is as follows. That is, a melt having the composition is quenched at a cooling speed of 100° C./sec or more by a quenching technique such as a single roll method to once prepare an alloy having an amorphous phase as a main phase, and the alloy is processed and annealed at a temperature in the vicinity of the crystallization temperature to form a nanocrystalline structure having an average grain diameter of 60 nm or less. Preparation of a thin ribbon by a quenching technique such as a single roll method and an annealing are conducted in air, or in an atmosphere of Ar, He, nitrogen, carbon monoxide, or carbon dioxide, or under reduced pressure. When an annealing is applied in a magnetic field, induced magnetic anisotropy enables improvement in soft magnetic properties. In this case, in order to impart induced magnetic anisotropy, an annealing in a magnetic field is conducted with a magnetic field applying for a certain period of time during an annealing. A magnetic field being applied may be any one of a direct current magnetic field, an alternating current magnetic field and a repetitively pulsed magnetic field. A magnetic field annealing is conducted usually for 20 min or more in the temperature region of 200° C. or more. When a magnetic field is applied during temperature rise, keeping at a constant temperature and cooling, the soft magnetic properties are improved. The inventive alloy contains Co and tends to cause induced magnetic anisotropy, and the magnetic properties may be improved by varying a B-H loop shape.

An annealing may be conducted in air, in vacuum or in an inert gas such as Ar or nitrogen. However, it is particularly preferably conducted in an inert gas. A maximum temperature during the annealing is desirably a temperature region substantially 70° C. higher than the crystallization temperature. When the keeping time of the annealing is set at 1 hr or more, though depending on the composition, the range from 350° C. to 470° C. is most suitable. A period of time keeping at a constant temperature is usually 24 hr or less and preferably 4 hr or less from the viewpoint of mass-productivity. The average heating rate during the annealing is preferably from 0.1° C./min to 10000° C./min and more preferably 100° C./min or more and thereby the coercive force is inhibited from increasing. An annealing may be carried out not by one stage but by multi-stages or by a plurality of times. Furthermore, an annealing may be applied by Joule heat by passing a current directly through an alloy or by annealing under pressure.

When an alloy of the present invention is prepared through the process mentioned above, a magnetic material having saturation magnetic flux density of 1.85 T or more and a coercive force of 120 A/m or less is readily obtained.

An annealing of an alloy of the present invention intends to form a nanocrystalline structure. By controlling two parameters of temperature and time, nucleus generation and the growth of crystal grains can be controlled. Even an annealing under a high temperature, when conducted for a very short period of time, has advantages. These are that crystal grains are inhibited from growing, the coercive force is made smaller, a magnetic flux density in a low magnetic field is improved and a hysteresis loss is reduced. Depending on desired magnetic properties, the annealing at a low temperature for a long period of time and the annealing at a high temperature for a short period of time can be appropriately separately used. However, the annealing at a high temperature for a short period of time is preferred because generally necessary magnetic properties are readily obtained.

The keeping temperature is preferably 430° C. or more. When the keeping temperature is less than 430° C., even by appropriately controlling the keeping temperature, the foregoing advantage is difficult to obtain. The keeping temperature is set preferably at, relative to the temperature ($T_{x2}$) where a compound precipitates, $T_{x2}-50°$ C. or more.

Furthermore, when an annealing is contained in a producing method, an annealing speed in a high temperature region affects characteristics; accordingly, when the annealing temperature exceeds 300° C., the heating rate is set preferably at 100° C./min or more, and when the annealing temperature exceeds 350° C., the heating rate is set more preferably at 100° C./min or more.

Furthermore, control of the heating rate, an annealing in several stages involving maintenance for a certain period of time at various temperatures, or the like can also nucleus generation. When crystal grains are grown by maintenance at a temperature lower than the crystallization temperature for a certain period of time to impart an enough time to generate nuclei, followed by an annealing involving maintenance for less than 1 hr at a temperature higher than the crystallization temperature, crystal grains inhibit each other from growing; accordingly, a homogeneous and fine crystalline structure is obtained. For example, when an annealing at substantially 250° C. is conducted for 1 hr or more, followed by conducting an annealing at a high temperature for a short time, for example, at a heating rate of 100° C./min or more when an annealing temperature exceeds 300° C., the same advantage as that of the foregoing producing method can be obtained.

When a soft magnetic nanocrystalline alloy of the present invention is treated, as required, by covering a surface of an alloy thin ribbon with a powder or film of $SiO_2$, MgO, $Al_2O_3$ or the like, by applying a surface treatment by a chemical conversion treatment to form an insulating layer, by forming an oxide insulating layer on a surface by anodic oxidation to apply interlayer insulation, or the like, a preferable result is obtained. This is because an eddy current in high frequency flowing over layers in particular is inhibited from adversely affecting to improve a magnetic core loss in high frequency. The advantage is particularly remarkable in a magnetic core formed of a wide thin ribbon excellent in a surface state. Furthermore, when a magnetic core is prepared from a magnetic alloy of the present invention, as required, impregnation or coating may be applied as well. A magnetic alloy of the present invention most exhibits its performance in an application where a pulse current flows as a high frequency application. However, the magnetic alloy of the present invention may be used in usage as a sensor or a low frequency magnetic part as well. In particular, the magnetic alloy of the present invention is capable of exhibiting excellent characteristics in applications where a magnetic saturation is problematic; accordingly, it is particularly suitable for an application in high-power power electronics.

In a magnetic alloy of the present invention, in which an annealing is applied with a magnetic field applying in a direction substantially vertical to the direction of magnetization during usage, a magnetic core loss smaller than a conventional material having high saturation magnetic flux density is obtained. Furthermore, a magnetic alloy of the present invention is capable of giving excellent characteristics even in a thin film or powder.

In at least a part or an entirety of a soft magnetic nanocrystalline alloy of the present invention, crystal grains having an average crystal grain diameter of 60 nm or less are formed. The crystal grains are desirably contained at a ratio of 30% or more of a structure, more desirably 50% or more, and particularly desirably 60% or more. A particularly desirable average grain diameter is from 2 nm to 30 nm, and, in the range, particularly low coercive force and magnetic core loss are obtained.

Nanocrystalline grains formed in a magnetic alloy of the present invention have a crystal phase of a body-centered cubic structure (bcc) mainly made of Fe and Co and may further form a solid solution with Si, B, Al, Ge, Zr or the like. Furthermore, the nanocrystalline grains may contain an ordered lattice. The remainder other than the crystal phase is mainly made of an amorphous phase. However, an alloy substantially made of a crystal phase alone as well is included in the present invention. A phase of a face-centered cubic structure (fcc phase) containing Cu or Au may be present.

When an amorphous phase is present around a crystal grain, the resistivity becomes higher, crystal grains are inhibited from growing to be microparticulated, and the soft magnetic properties are improved; accordingly, a more preferable result is obtained.

In the inventive alloy, when a compound phase is not present, a lower magnetic core loss is obtained. However, a compound phase may be partially contained.

A second aspect of the present invention relates to a magnetic part that uses the magnetic alloy. When a magnetic part is constituted of the magnetic alloy of the present invention, a high performance or miniaturized magnetic part is realized suitable for various reactors for a large current such as an anode reactor, choke coils for an active filter, smoothing choke coils, various transformers, magnetic shields, noise-suppression parts such as a magnetic shield material, laser power supplies, pulsed-power magnetic parts for accelerators, motors, generators and so on.

ADVANTAGES OF THE INVENTION

According to the present invention, a soft magnetic nanocrystalline alloy that shows particularly low magnetic core loss at high saturation magnetic flux density that is used for various transformers, various reactors for high current, noise-suppression parts such as an electromagnetic shield material, laser power supplies, pulsed-power magnetic parts for accelerators, choke coils for active filters, smoothing choke coils, motors, generators, and so on, and is readily annealed because the range of the optimum annealing conditions is wide; and a high performance magnetic part therewith can be realized; accordingly, advantages thereof are remarkable.

BEST MODE FOR CARRYING OUT THE INVENTION

In what follows, the present invention will be described with reference to Examples. However, the present invention is not restricted thereto.

EXAMPLE 1

A molten alloy having a composition of $Fe_{bal.}Co_{15}Cu_{1.5}B_{14}Si_2$ (by atomic percent) was quenched by a single roll method and thereby a thin ribbon of the amorphous alloy having a width of 10 mm and a thickness of 19 μm was obtained. As a result of X-ray diffraction and transmission electron microscope observation, it was confirmed that, in a thin ribbon of an amorphous alloy, nanoscale very fine crystal grains having a grain diameter of less than 10 nm were formed at a volume fraction of less than 30%. The crystal grain is considered a solid solution phase mainly having a body-centered cubic structure (bcc structure) with FeCo as a main component.

The thin ribbon of an amorphous alloy was heated up to 430° C. at a rate of temperature rise of 200° C./min and kept there for 1 hr, further followed by cooling in air after taking out of a furnace. The annealed sample was subjected to X-ray diffraction and a structure observation with a transmission electron microscope. A phase of nanocrystalline grains having a grain diameter of substantially 25 nm and a bcc structure was present at a volume fraction of 50% or more in an amorphous matrix phase. Then, the sample was cut into a length of 12 cm, followed by subjecting to a magnetic measurement. The magnetic flux density roughly saturates at a magnetic field of 8000 A/m and the magnetic flux density at 8000 A/m was referred to as Bs. The saturation magnetic flux density Bs was 1.94 T and a coercive force Hc was 17 A/m, that is, high Bs and low coercive force were shown. Furthermore, a nozzle life was substantially 1.5 times a conventional $Fe_{bal.}Co_{29.4}Cu_1Nb_2B_{12}Si_1$ alloy that has substantially the same Bs.

EXAMPLE 2

A molten alloy represented by the compositional formula $Fe_{82.65x}Co_xCu_{1.35}B_{14}Si_2$ (by atomic percent) was quenched by a single roll method and thereby a thin ribbon of the amorphous alloy having a width of 5 mm and a thickness of 18 μm was obtained. Then, X-ray diffraction and transmission electron microscope observation were conducted. It was confirmed that, in the thin ribbon of the amorphous alloy, nanoscale crystal grains having a grain diameter of less than 10 nm were formed at a volume fraction of less than 30%. The crystal grain is considered a solid solution phase mainly having a body-centered cubic structure (bcc structure) with FeCo as a main component.

Next, the thin ribbon of the amorphous alloy was heated up to 430° C. at a rate of temperature rise of 200° C./min and kept there for 1 hr, further followed by cooling in air after taking out of a furnace. The annealed sample was then subjected to X-ray diffraction and a structure observation with a transmission electron microscope. A phase of nanocrystalline crystal grains having a grain diameter of substantially 25 nm and a bcc structure was present at a volume fraction of 50% or more in an amorphous matrix phase. Then, the sample was cut into a length of 12 cm, followed by subjecting to a magnetic measurement. FIG. 1 shows the dependence of saturation magnetic flux density Bs and coercive force Hc on Co content. In the range where the amount of Co (x) satisfying $10<x<25$ (by atomic percent), excellent characteristics that Bs is 1.85 T or more and Hc is 200 A/m or less were obtained.

EXAMPLE 3

Molten alloys having various compositions shown in Table 1 were quenched by a single roll method, and thereby thin ribbons of the amorphous alloys having a width of 5 mm and thicknesses from 18 to 25 μm were obtained. The alloy thin ribbons were annealed in the range from 350° C. to 460° C., followed by evaluating each of the annealed single plate samples with a B-H tracer. In each of the annealed magnetic alloys, at least a part of the structure thereof contained crystal grains having a crystal grain diameter of 60 nm or less (not including 0). A nanocrystalline phase was also contained in an amorphous matrix phase at a volume fraction of 50% or more.

Table 1 shows the saturation magnetic flux density $B_s$, coercive force $H_c$, and maximum magnetic permeability $\mu_m$ under the annealing conditions where the coercive force of the sample is the lowest. For the purposes of comparison, the magnetic properties of conventional nanocrystalline alloys are shown.

The alloys of the present invention are, when compared with the conventional nanocrystalline alloys, low in coercive force, high in maximum magnetic permeability and excellent in soft magnetic properties for alloys having 1.85 T or more. The conventional nanocrystalline alloys low in coercive force and excellent in soft magnetic properties have a saturation magnetic flux density Bs of less than 1.85 T, which is lower than Bs of the inventive alloy. As mentioned above, the inventive alloy is excellent in soft magnetic properties with a saturation magnetic flux density higher than that of the conventional nanocrystalline alloys. Accordingly, the inventive alloy, when applied to a magnetic core material of choke coils, transformers and so on, can contribute to miniaturization and reduced loss.

TABLE 1

| | No. | Composition (by atomic percent) | Plate thickness t (μm) | Saturation magnetic flux density Bs(T) | Coercive force Hc (A/m) | Maximum magnetic permeability $\mu_m$ ($10^3$) |
|---|---|---|---|---|---|---|
| Examples of Present Invention | 1 | $Fe_{bal.}Co_{15}Cu_{1.35}B_{14}Si_2$ | 19.1 | 1.91 | 23 | 41 |
| | 2 | $Fe_{bal.}Co_{20}Cu_{1.45}B_{14}Si_2$ | 19.5 | 1.86 | 128 | 6.2 |
| | 3 | $Fe_{bal.}Co_{20}Cu_{1.5}B_{14}Si_2$ | 20.1 | 1.88 | 31 | 16 |
| | 4 | $Fe_{bal.}Co_{24}Cu_{1.5}B_{14}Si_2$ | 20.3 | 1.89 | 29 | 16 |
| | 5 | $Fe_{bal.}Co_{12}Cu_{2.0}B_{13}Si_2$ | 19.0 | 1.85 | 12 | 64 |
| | 6 | $Fe_{bal.}Co_{15}Cu_{1.1}B_{14}Si_{1.5}Ge_{0.5}$ | 20.1 | 1.88 | 28 | 32 |
| | 7 | $Fe_{bal.}Co_{15}Cu_{1.35}B_{14}Si_{1.5}C_{0.5}Ga_{0.3}$ | 21.2 | 1.87 | 31 | 30 |
| | 8 | $Fe_{bal.}Co_{23}Cu_{1.35}B_{14}Si_1P_{1.5}$ | 20.3 | 1.85 | 117 | 7.3 |
| | 9 | $Fe_{bal.}Co_{15}Cu_{1.35}B_{14}Si_{1.5}Al_{0.5}Be_{0.2}$ | 19.8 | 1.86 | 28 | 17 |
| | 10 | $Fe_{bal.}Co_{11}Cu_{1.35}B_{14}Si_{1.5}S_{0.01}$ | 18.1 | 1.87 | 27 | 18 |
| | 11 | $Fe_{bal.}Co_{15}Cu_{1.15}B_{14}Si_{1.5}Au_{0.2}$ | 22.0 | 1.88 | 22 | 37 |
| | 12 | $Fe_{bal.}Co_{12}Cu_{1.35}B_{14}Si_{1.5}Nb_{0.5}$ | 21.5 | 1.85 | 11 | 16 |
| | 13 | $Fe_{bal.}Co_{14}Cu_{1.35}B_{14}Si_{1.5}Mn_{0.5}$ | 20.8 | 1.87 | 22 | 38 |

TABLE 1-continued

| | No. | Composition (by atomic percent) | Plate thickness t (μm) | Saturation magnetic flux density Bs(T) | Coercive force Hc (A/m) | Maximum magnetic permeability $\mu_m$ ($10^3$) |
|---|---|---|---|---|---|---|
| | 14 | $Fe_{bal.}Co_{15}Cu_{1.35}B_{14}Si_{1.5}Mo_{0.3}Ta_{0.2}$ | 21.2 | 1.86 | 20 | 48 |
| | 15 | $Fe_{bal.}Co_{15}Cu_{1.35}B_{18}$ | 20.5 | 1.86 | 67 | 8.2 |
| | 16 | $Fe_{bal.}Co_{15}Cu_{1.35}B_{10}Si_5Cr_{0.5}$ | 22.8 | 1.87 | 22 | 37 |
| | 17 | $Fe_{bal.}Co_{15}Cu_{1.35}B_{14}Si_1Ni_{1.8}$ | 21.5 | 1.86 | 20 | 50 |
| | 18 | $Fe_{bal.}Co_{15}Cu_{1.35}B_{12}Si_3V_{0.5}$ | 20.7 | 1.86 | 21 | 45 |
| | 19 | $Fe_{bal.}Co_{15}Cu_{1.45}B_{13}Si_{4.5}W_{0.5}Pt_{0.2}$ | 20.3 | 1.86 | 23 | 41 |
| | 20 | $Fe_{bal.}Co_{15}Cu_{1.55}B_{14}Si_{1.2}Zr_{0.5}$ | 20.6 | 1.86 | 24 | 38 |
| | 21 | $Fe_{bal.}Co_{15}Cu_{1.8}B_{14}Si_{1.5}Hf_{0.3}$ | 19.8 | 1.85 | 23 | 40 |
| | 22 | $Fe_{bal.}Co_{15}Cu_{1.35}B_{14}Si_{1.5}Ti_{0.5}$ | 19.4 | 1.87 | 26 | 23 |
| | 23 | $Fe_{bal.}Co_{15}Cu_{1.35}B_{14}Si_{1.5}Re_{0.2}Ag_{0.1}$ | 19.5 | 1.86 | 28 | 29 |
| Comparative Example | 24 | $Fe_{bal.}Co_{29.4}Cu_1Nb_2Si_1B_{12}$ | 19.0 | 1.89 | 240 | 4.1 |
| | 25 | $Fe_{bal.}Zr_7B_3$ | 19.2 | 1.63 | 5.6 | 120 |
| | 26 | $Fe_{bal.}Cu_1Nb_3Si_{13.5}B_9$ | 18.0 | 1.24 | 0.5 | 800 |
| | 27 | $Fe_{bal.}Co_{29.75}Cu_1Nb_7Si_1B_8$ | 19.1 | 1.71 | 16.8 | 3.8 |
| | 28 | $Fe_{bal.}Nb_7B_9$ | 22.0 | 1.49 | 8.0 | 7.2 |
| | 29 | $Fe_{bal.}Cu_{0.6}Nb_{2.6}Si_9B_9$ | 19.6 | 1.50 | 0.6 | 790 |
| | 30 | $Fe_{bal.}Cu_1Nb_3Si_{16.5}B_6$ | 19.1 | 1.20 | 0.8 | 705 |

BRIEF DESCRIPTION OF THE DRAWING

FIG. 1 is a diagram showing the saturation magnetic flux density Bs and coercive force Hc of an $Fe_{82.65-x}Co_xCu_{1.35}B_{14}Si_2$ alloy.

The invention claimed is:

1. A magnetic alloy represented by the compositional formula: $Fe_{100-x-y-z-a}Co_aCu_xB_yX_z$ wherein, X is one or more elements selected from the group consisting of Si, S, C, P, Al, Ge, Ga and Be, and, in terms of atomic percent, $1<x\leqq3$, $10\leqq y\leqq20$, $0<z\leqq10$, $10<a<25$ and $10<y+z\leqq24$, and y is greater than z, wherein crystal grains having a crystal grain diameter of 60 nm or less are dispersed at a volume fraction of 30% or more in an amorphous matrix phase and the magnetic alloy has a saturation magnetic flux density of 1.85 T or more and a coercive force of 200 A/m or less.

2. The magnetic alloy according to claim 1, wherein the X is one or more elements selected from the group consisting of Si and P.

3. The magnetic alloy according to claim 1, wherein the magnetic alloy is obtained by annealing an amorphous alloy having a structure where nanoscale crystal grains having a grain diameter of less than 10 nm are dispersed in an amorphous phase at a volume fraction of less than 30%.

4. The magnetic alloy according to claim 1, wherein the amount of Cu (x) satisfies $1<x\leqq2$.

5. The magnetic alloy according to claim 1, wherein the magnetic alloy contains less than 2 atomic % of Ni with respect to the amount of Fe.

6. The magnetic alloy according to claim 1, wherein the magnetic alloy contains, with respect to the amount of Fe, less than 1 atomic % of one or more elements selected from Ti, Zr, Hf, V, Nb, Ta, Cr, Mo, W, Mn, Re, platinum group elements, Au, Ag, Zn, In, Sn, As, Sb, Sb, Bi, Y, N, O and rare earth elements.

7. The magnetic alloy according to claim 1, wherein B (y) is $12\leqq y\leqq17$.

* * * * *